US010662942B2

(12) United States Patent
Ide

(10) Patent No.: US 10,662,942 B2
(45) Date of Patent: May 26, 2020

(54) OIL PUMP

(71) Applicant: JATCO Ltd, Fuji-shi, Shizuoka (JP)

(72) Inventor: Atsuyuki Ide, Fuji (JP)

(73) Assignee: JATCO LTD, Fuji-Shi (JP)

( * ) Notice: Subject to any disclaimer, the term of this patent is extended or adjusted under 35 U.S.C. 154(b) by 300 days.

(21) Appl. No.: 15/560,674

(22) PCT Filed: Feb. 16, 2016

(86) PCT No.: PCT/JP2016/054355
§ 371 (c)(1),
(2) Date: Sep. 22, 2017

(87) PCT Pub. No.: WO2016/152319
PCT Pub. Date: Sep. 29, 2016

(65) Prior Publication Data

US 2018/0106251 A1 Apr. 19, 2018

(30) Foreign Application Priority Data

Mar. 26, 2015 (JP) ..... 2015-063701

(51) Int. Cl.

| | |
|---|---|
| ***F04C 2/10*** | (2006.01) |
| ***F04C 15/06*** | (2006.01) |
| ***F04C 15/00*** | (2006.01) |
| ***F04C 14/18*** | (2006.01) |

(52) U.S. Cl.
CPC ..... *F04C 2/10* (2013.01); *F04C 15/0049* (2013.01); *F04C 15/06* (2013.01); *F04C 15/064* (2013.01); *F04C 14/18* (2013.01); *F04C 2250/102* (2013.01)

(58) Field of Classification Search
CPC ..... F04C 14/18; F04C 15/0049; F04C 15/06; F04C 15/064; F04C 2250/102; F04C 2/10; F04C 11/008
USPC ..... 418/166, 191; 417/410.1
See application file for complete search history.

(56) References Cited

U.S. PATENT DOCUMENTS

2012/0128513 A1* 5/2012 Sakata ..... F04C 11/008 417/410.1

FOREIGN PATENT DOCUMENTS

JP 2014-173587 A 9/2014

* cited by examiner

*Primary Examiner* — Patrick Hamo
*Assistant Examiner* — Paul W Thiede
(74) *Attorney, Agent, or Firm* — Foley & Lardner LLP

(57) ABSTRACT

An oil pump is provided with an inner rotor having external teeth, an outer rotor disposed in a loose-fit state within a pump chamber and having internal teeth meshed with the external teeth, a ring-shaped pressure chamber provided adjacent to the pump chamber in a direction of a rotation axis, a discharge opening for connecting the pump chamber and the pressure chamber, and a cylindrical discharge passage having one end connected to the pressure chamber and the other end serving as a connection opening. A portion of the discharge passage is located to open inside of the outer periphery of the pressure chamber when viewed in the rotation axis direction. The one end reaches to a middle of the pressure chamber when viewed in a radial direction of the rotation axis, and the discharge passage and the pressure chamber are in direct communication with each other.

5 Claims, 5 Drawing Sheets

PRIOR ART

OIL PUMP

TECHNICAL FIELD

The present invention relates to an oil pump.

BACKGROUND ART

A vane oil pump has been disclosed in Patent document 1. This type of vane oil pump is often mounted on a vehicular automatic transmission and used for supplying hydraulic pressure for the purpose of controlling the automatic transmission.

Referring to FIG. 5, there is shown an explanatory drawing illustrating a vane oil pump 90 of a conventional example (a comparative example). FIG. 5*a* is a sectional view of the oil pump 90, whereas FIG. 5*h* is an enlarged view in and around an interconnection portion (a flow constriction 98) for interconnecting a pressure chamber 97 and a discharge passage 99.

Vane oil pump 90 shown in FIG. 5 is provided with an inner rotor 94 configured to rotate integral with a shaft 20, and an outer rotor 95 configured to surround the outer periphery of the inner rotor 94. These rotors, that is, inner rotor 94 and outer rotor 95 are housed in a pump chamber 920 formed in a body case 91 constructed by a housing 92 and a cover 93.

In this oil pump 90, spaces, which are defined between an external toothed portion formed on the outer periphery of inner rotor 94 and an internal toothed portion formed on the inner periphery of outer rotor 95, are displaced around the rotation axis X of the inner rotor, while periodically increasing and decreasing their volumes during rotation of inner rotor 94. That is, oil pump 90 utilizes the circumferential displacement of each individual space whose volume periodically increases and decreases, for pressurizing oil sucked from a suction port of the oil pump 90 and for discharging the pressurized oil through a discharge opening 960 formed in a wall member 96.

Also, in the oil pump 90, regarding the spaces, which are defined between the external toothed portion of the inner rotor 94 and the internal toothed portion of the outer rotor 95 both rotating, a plurality of spaces exist in the circumferential direction around the rotation axis X. When each of the spaces passes through the specified position corresponding to the discharge opening 960, its volume becomes narrowest, thereby permitting the oil in the space to be discharged through the discharge opening 960.

By the way, each of the plurality of spaces, which exist in the circumferential direction around the rotation axis X, intermittently passes through the discharge opening 960, and thus fluid-flow pulsation occurs in the oil discharged through the discharge opening 960.

Therefore, assuming that the discharge opening 960 has been connected directly to a downstream-side discharge passage 99, the aforementioned pulsation would be just transmitted to the oil flowing through a downstream-side oil passage 100.

In the oil pump 90 of the conventional example, the ring-shaped pressure chamber 97 is provided adjacent to the discharge opening 960 for reducing or dampening the fluid-flow pulsation of the oil discharged through the discharge opening 960 within the pressure chamber 97 and for supplying the oil whose pulsation has been reduced within the pressure chamber through the flow constriction 98 (serving as a flow control valve) via the downstream-side discharge passage 99 into the downstream-side oil passage 100.

On one hand, the flow constriction 98 exhibits an oil pulsation suppression function that the pulsation of oil supplied to the downstream-side discharge passage 99 is further suppressed. On the other hand, the flow constriction 98 serves as a flow resistance that impedes the flow of oil moving or flowing from the pressure chamber 97 toward the downstream-side discharge passage 99. Therefore, in the case that the oil pump 90 is driven by output rotation of a driving power source (for example, an engine), the fuel economy of a driving-power-source equipped vehicle may be deteriorated.

For the reasons discussed above, the abolition of the flow control valve (the flow constriction) has been studied or examined. However, suppose that the flow control valve has been abolished and thus the flow constriction 98 has been eliminated. In such a case, a contributory portion of the flow constriction 98 that contributes to a reduction of pulsation also disappears, and thus the pulsation of oil supplied to the downstream-side discharge passage 99 is undesirably increased.

Therefore, it would be desirable to suppress or prevent the pulsation in a downstream-side oil passage from being undesirably increased even when a flow control valve (a flow constriction), provided downstream of a discharge opening of an oil pump, has been abolished.

CITATION LIST

Patent Literature

Patent document 1: Japanese Patent Provisional Publication No. JP2014-173587

SUMMARY OF INVENTION

In the present invention, an oil pump is provided with an inner rotor configured to rotate integral with a drive shaft around a rotation axis, an outer rotor disposed in a loose-fit state within a pump chamber formed in a housing and having an internal toothed portion provided on an inner periphery of the outer rotor and meshed with an external toothed portion provided on an outer periphery of the inner rotor, a space provided adjacent to the pump chamber in a direction of the rotation axis and formed into a ring shape surrounding the rotation axis, when viewed in the rotation axis direction, a connection passage for connecting the pump chamber and the space, and a discharge passage formed to extend parallel to the rotation axis in the housing and having one end connected to the space in a longitudinal direction and the other end serving as a discharge port that opens at a position spaced away from the pump chamber than the space in the rotation axis direction. The discharge passage is formed to have a circular cross-sectional shape when viewed in the rotation axis direction, and is provided at a position bridging the inside and outside of the outer periphery of the space when viewed in the rotation axis direction. The one end of the discharge passage is provided at a position reaching to a middle of the space when viewed in a radial direction of the rotation axis, and the discharge passage and the space are in direct communication with each other.

According to the invention, the space, into which the pressurized oil within the pump chamber first flows, and the discharge passage, through which the pressurized oil supplied into the space is introduced into the discharge port, are in direct communication with each other. Hence, there is not any flow-constricting part serving as a flow resistance to the flow of oil flowing from the space into the discharge passage and provided between the space and the discharge passage.

Therefore, a portion of the discharge passage is also utilized as a part of the space, and thus the volume of the space can be regarded as to be increased by a volumetric capacity corresponding to the discharge passage. By virtue of the increased volume of the space, the effect that suppresses the pulsation of the pressurized oil flowing from the pump chamber into the space can be enhanced accordingly.

With the configuration as discussed above, it is possible to enlarge the volume of the fluid-flow space that can function as the space without increasing the actual volume of the space itself. Therefore, it is possible to more effectively suppress the pulsation of the pressurized oil.

DESCRIPTION OF EMBODIMENTS

Embodiment

Figure 1A:
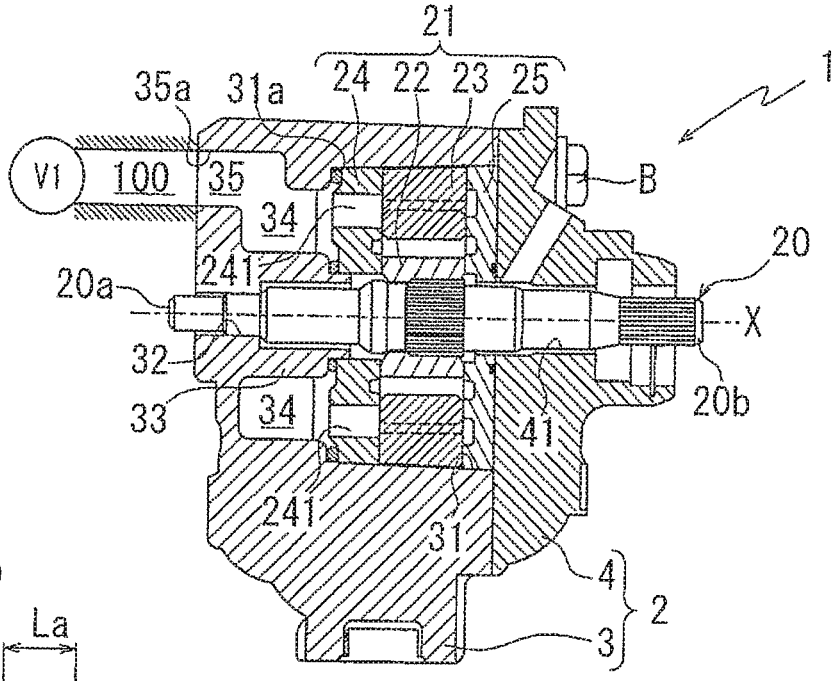
FIG. 1 is an explanatory drawing illustrating an oil pump of an embodiment.

The embodiment of the invention is hereinafter explained in detail and exemplified in a vane oil pump 1 in a similar manner to the oil pump 90 of the conventional example.

Referring to FIG. 1, there is shown an explanatory drawing illustrating the oil pump 1 of the embodiment. Hereupon, FIG. 1*a* is a sectional view illustrating the oil pump 1, cut along a rotation axis X, FIG. 1*b* is an enlarged view in and around a pressure chamber 34 shown in FIG. 1*a*, FIG. 1*c* is an enlarged view near a communication port 36 through which the pressure chamber 34 communicates with a discharge passage 35, and FIG. 1*d* is a reference perspective view illustrating a state of the communication port 36 between the pressure chamber 34 and the discharge passage 35, when viewed from the side of pressure chamber 34.

Figure 1B:
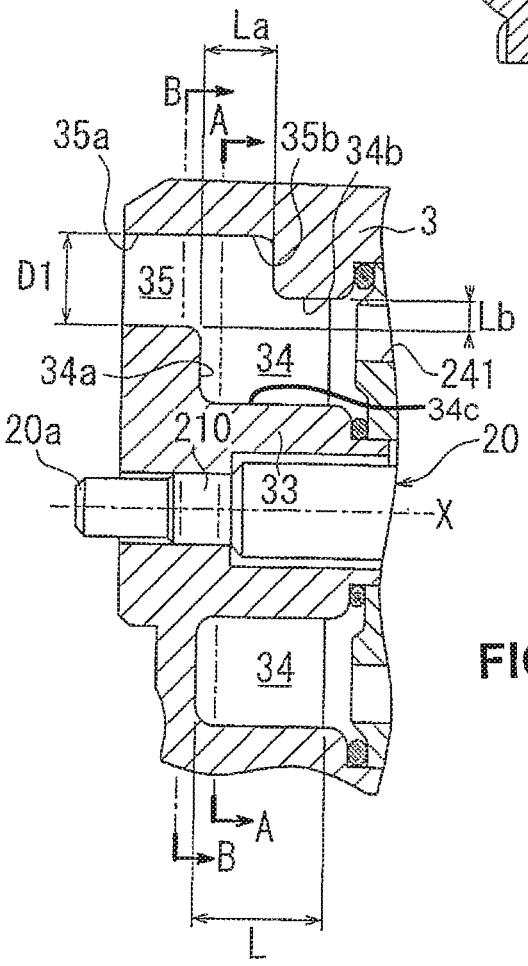
Figure 1C:
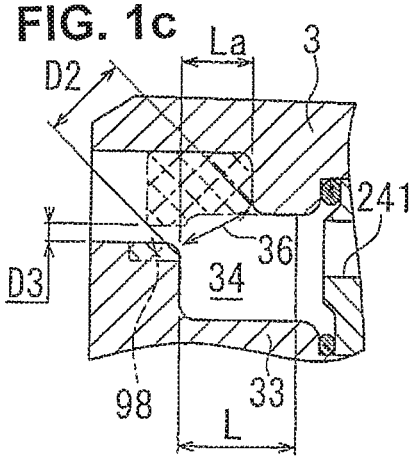
Figure 1D:
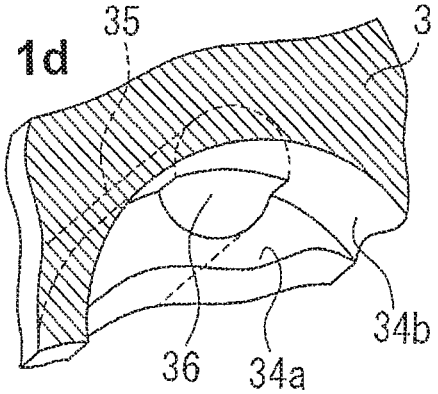

By the way, in FIG. 1*c*, for the purpose of clarifying the difference between the oil pump of the embodiment and the oil pump 90 of the conventional example, a region or a portion (i.e., flow constriction 98) that has existed in the oil pump 90 of the conventional example, but eliminated in the oil pump 1 of the embodiment is indicated by cross-hatching.

As shown in FIG. 1, a body case 2 of oil pump 1 is comprised of a housing 3 and a cover 4 assembled each other. A bottomed cylindrical pump chamber 31 is formed in an opposing face of the housing 3 opposed to the cover 4. By fixing the cover 4 to the housing 3 with bolts B after the cover 4 has been assembled onto the housing 3, the closed pump chamber 31 (closed space) is defined inside of the body case 2.

A through hole 32 for a shaft 20 is formed in the housing 3 along the center of the pump chamber 31. The through hole 32 is formed so as to penetrate the housing 3 in the direction of rotation axis X (hereinafter referred to as "rotation axis X direction").

One end 20*a* of shaft 20 is structured to penetrate the through hole 32 and located outside of the body case 2. A journal 210 of the one end 20*a* of shaft 20 is rotatably supported by the through hole 32.

Housing 3 has a cylindrical wall portion 33 configured to surround the through hole 32 with a specified clearance. A ring-shaped pressure chamber 34 is configured to open into a bottom 31*a* of the pump chamber 31 in a manner so as to surround the cylindrical wall portion 33 with a specified annular clearance.

An inner rotor 22 is splined and fixed onto the outer periphery of the shaft 20, ranging within the pump chamber 31. When the shaft 20 is rotated by a rotational driving force produced by a driving power source (not shown), the shaft 20 and the inner rotor 22 rotate integral with each other around the rotation axis X.

A ring-shaped outer rotor 23 is located radially outside of inner rotor 22 when viewed in the rotation axis X direction. In a meshed-engagement state wherein the internal toothed portion (not shown) provided on the inner periphery of outer rotor 23 is in meshed-engagement with the external toothed portion (not shown) provided on the outer periphery of inner rotor 22, the outer rotor is located radially outside of inner rotor 22. Outer rotor 23 is disposed in a loose-fit state within the inner periphery of pump chamber 31.

Ring-shaped wall members 24, 25 are fitted onto both sides of inner rotor 22 and outer rotor 23, and mounted on the shaft 20, such that inner rotor 22 and outer rotor 23 are installed on the shaft in a sandwiched state between these two wall members 24, 25.

In the shown embodiment, a pump assembly 21 is constructed such that inner rotor 22 and outer rotor 23 are sandwiched between two wall members 24, 25. In this state, inner rotor 22 and outer rotor 23, which are sandwiched between these two wall members 24, 25, are structured to be rotatable (slidable) relative to respective wall members 24, 25.

With the pump assembly 21 constructed as discussed above, by rotary motions of inner rotor 21 and outer rotor 23 operating within the pump assembly 21, oil is sucked and pressurized. The pressurized oil is discharged from a discharge opening 241 formed in the wall member 24.

In the shown embodiment, the pump assembly 21 is installed on the shaft 20. Shaft 20 and inner rotor 22 are connected to each other such that relative rotation between them is disabled. Thereafter, by inserting the one end 20*a* of shaft 20 into the through hole 32 of housing 3 from the side of cover 4, the shaft 20 and the pump assembly 21 are assembled into the housing 3.

Cover 4 is formed with a through hole 41 at a position conformable to the shaft 20 assembled to the housing 3. Hence, in a state where the cover 4 has been assembled to the housing 3, the other end 20*b* of shaft 20 is located to protrude outside of the body case 2. The other axial end side, corresponding to the other end 20*b* of shaft, is rotatably supported by the through hole 41.

Under these conditions, pump assembly 21 is disposed in the pump chamber 31 such that the pump assembly is sandwiched between the bottom 31*a* of pump chamber 31 and the cover 4, and that axial movement of the pump assembly in the rotation axis X direction is restricted.

The wall member 25 of pump assembly 21, which is located on the side of cover 4, has an oil supply port (not shown), which is an opening in an opposing face of this wall member opposed to the pump chamber 31, for supplying oil sucked through a strainer (not shown).

Also, the wall member 24, which is located on the opposite side to the wall member 25, sandwiching inner rotor 22 and outer rotor 23 between them, has the discharge opening 241 formed to penetrate the wall member 24 in the rotation axis X direction. The discharge opening 241 permits the internal space of pump assembly 21 to communicate with the pressure chamber 34 that opens into the bottom 31*a* of pump chamber 31.

Hence, the oil, pressurized within the pump assembly 21, is supplied through the discharge opening 241 into the pressure chamber 34.

Figure 2A:
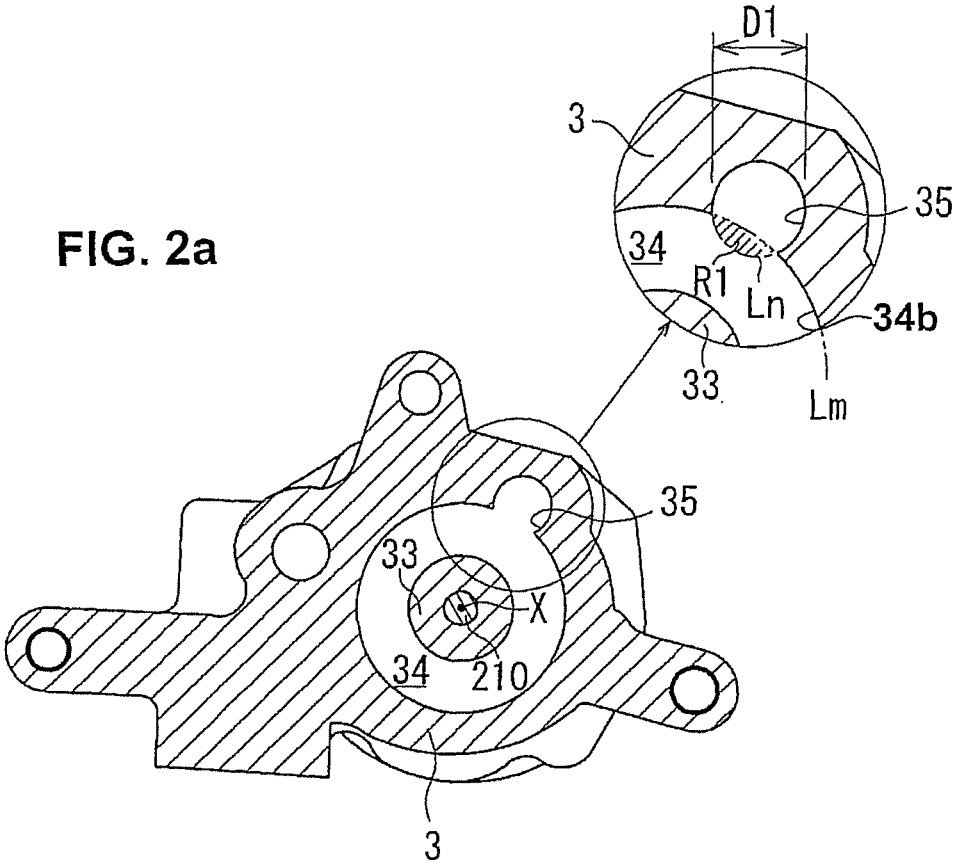
FIG. 2 is a cross-sectional view illustrating the oil pump of the embodiment.

The pressure chamber 34 of housing 8 is formed into a ring shape surrounding the rotation axis X (the circumference of the rotation axis) with a specified annular clearance (see FIG. 2*a*). One end 35*b* of the discharge passage 35, which is formed in the housing 3 so as to extend along the rotation axis X direction, is in fluid-communication with the pressure chamber 34 at a position closer to the outside diameter part of the ring-shaped pressure chamber 34 when viewed in the rotation axis X direction.

Figure 2B:
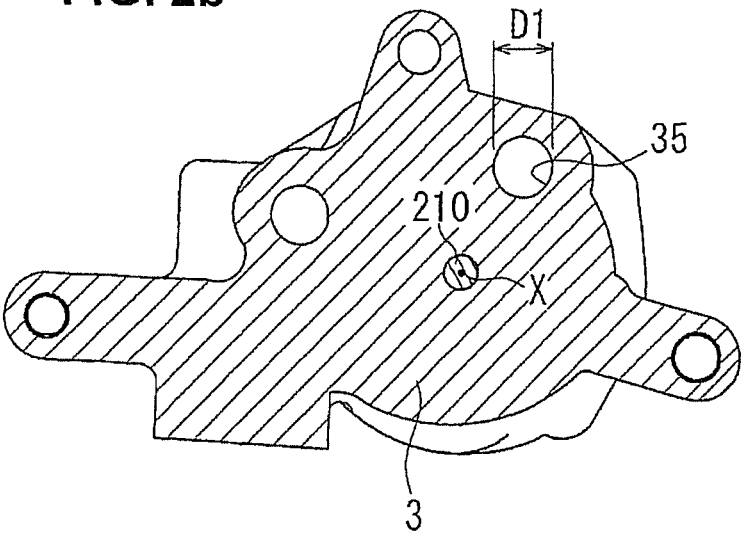

Discharge passage 35 is formed to have a circular cross-sectional shape when viewed in the axial direction of rotation axis X (see FIG. 2*b*). Also, discharge passage 35 is formed in the housing 3 at a position bridging the inside and outside of an outer peripheral edge part 34*b* of pressure chamber 34 when viewed in the axial direction of rotation axis X.

Hence, discharge passage 35 and pressure chamber 34 are in fluid-communication with each other so as to cross each other in a crossed, positional relationship between a virtual curve Lm of the outer peripheral edge part 34*b* virtually extending along the outer circumference of pressure chamber 34 and a virtual curve Ln of the one end of the discharge passage virtually extending along the inner circumference of discharge passage 35, when viewed in the axial direction of rotation axis X (see the region R1 shown in FIG. 2*a*).

As shown in FIG. 1*b*, discharge passage 35 is also formed to straightly extend parallel to the rotation axis X when viewed in the radial direction of rotation axis X. A connection opening 35*a* corresponding to the other end of discharge passage 35 is configured to open at a position spaced away from the pump chamber 31 than the pressure chamber 34 in the axial direction of rotation axis X.

The one end 35*b* of discharge passage 35 is located so as to extend from the bottom 34*a* of pressure chamber 34 toward the pump chamber 31 by an axial length (a crossing length) La reaching to a substantially middle position of pressure chamber 34 in the rotation axis X direction (see the axial length La dimensioned to be approximately one-half of an axial length L of pressure chamber 34 in FIGS. 1*b*-1*c*). Accordingly, the one end 35*b* of discharge passage 35 is in direct-communication with the pressure chamber 34. A specified opening formed on the border between the discharge passage 35 and the pressure chamber 34 serves as a communication port 36 through which the discharge passage 35 communicates with the pressure chamber 34.

In the shown embodiment, the crossing amount La between the discharge passage 35 and the pressure chamber 34 in the axial direction of rotation axis X and the crossing amount Lb between the discharge passage 35 and the pressure chamber 34 in the radial direction of rotation axis X are set such that the opening area D2 of communication port 36 is dimensioned to be greater than or equal to the opening area D1 of connection opening 35*a* corresponding to the other end of discharge passage 35 (i.e., D2≥D1).

Figure 5A:
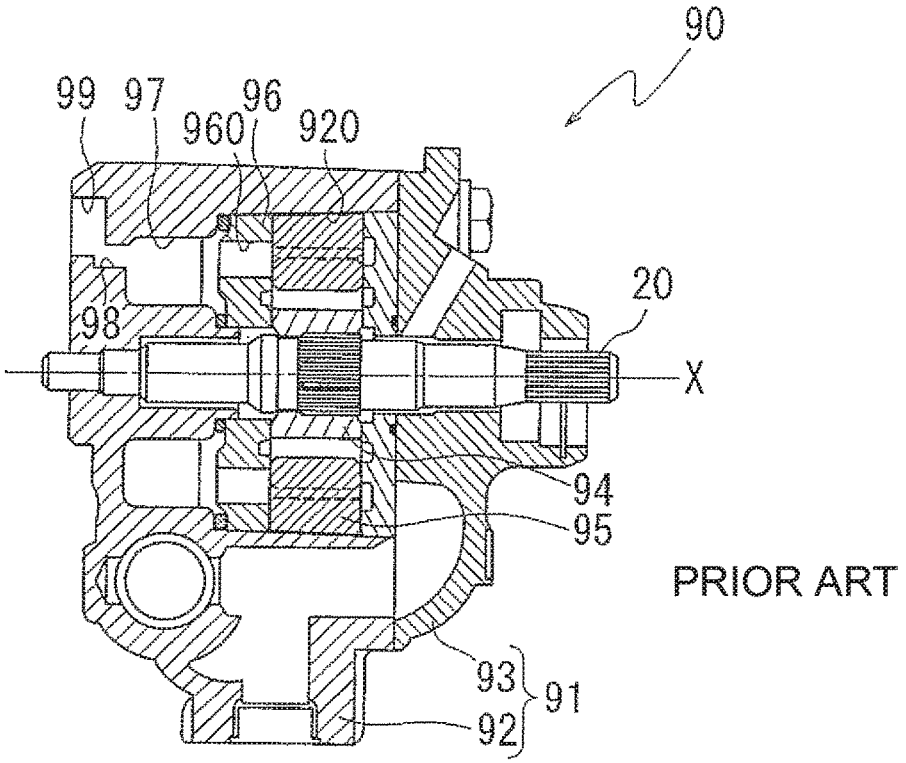
FIG. 5 is an explanatory drawing illustrating the oil pump of a conventional example.
Figure 5B:
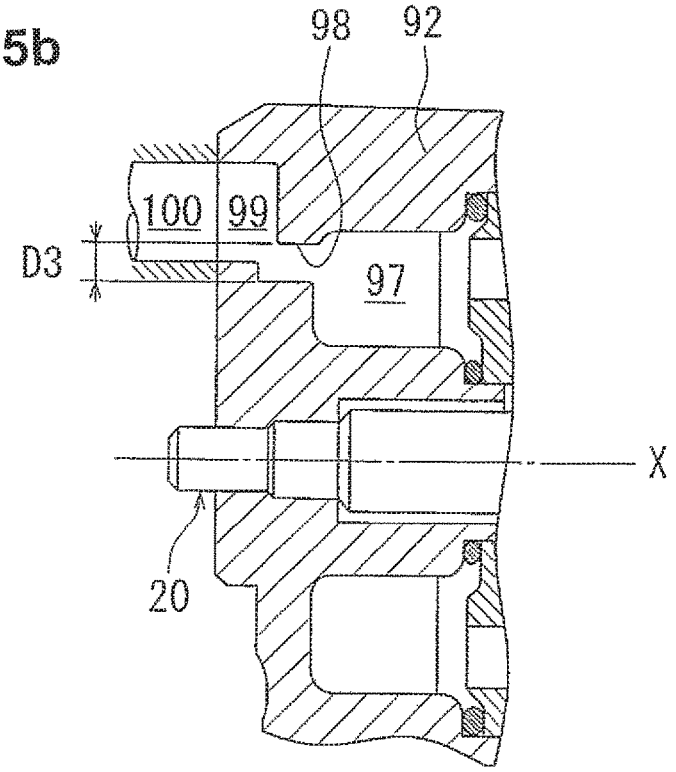
PRIOR ART FIG. 5b

By the way, as shown in FIG. 5 (the conventional example) and FIG. 1*c*, in the oil pump of the conventional example, the pressure chamber 34 and the discharge passage 35 are connected to each other through the flow constriction 98 (see the cross-hatching of FIG. 1*c*), and thus the opening area D3 of the flow constriction 98 is narrow. Thus, the flow constriction 98 serves as a flow resistance to the flow of oil passing through the flow constriction 98, thereby resulting in an increase in pressure loss when the oil passes through the flow constriction 98.

In the present invention, the one end 35*b* of discharge passage 35 is provided at a position reaching to a middle of the pressure chamber 34 when viewed in the radial direction of rotation axis X. Additionally, the discharge passage 35 is provided at a position bridging the inside and outside of the outer peripheral edge part 34*b* of pressure chamber 34 when viewed in the rotation axis X direction, and thus the discharge passage 35 and the pressure chamber 34 are in direct-communication with each other. Hence, the opening area D2 of communication port 36 is configured and dimensioned to be sufficiently greater than the opening area D3 of flow constriction 98.

Hitherto, owing to the flow constriction 98*a* flow resistance has impeded the flow of oil moving from the pressure chamber through the communication port toward the discharge passage. In contrast, in the shown embodiment, owing to the flow constriction being eliminated, there is less flow resistance to the flow of oil moving or flowing from the pressure chamber 34 through the communication port 36 toward the discharge passage 35. Hence, a portion of the discharge passage 35 can be utilized as a space which continues on to the pressure chamber 34.

Therefore, in the case of the embodiment, the volume of pressure chamber 34, which is provided for suppressing the oil pulsation, can be regarded as to be increased by a volumetric capacity corresponding to the discharge passage 35. By virtue of the increased volume of the space, a more improved effect that suppresses the pulsation can be expected.

By the way, the downstream-side oil passage 100, which extends to a pressure control valve V1 located downstream of the oil pump 1, is connected to the connection opening 35*a* of discharge passage 35. In the shown embodiment, the inside diameter of oil passage 100 and the inside diameter of discharge passage 35 are dimensioned to be identical to each other, in a manner so as to prevent a flow passage cross-sectional area of the connecting portion of oil passage 100 and discharge passage 35 from narrowing.

Accordingly, the volume of oil passage 100 as well as the volume of discharge passage 35 can be utilized and regarded as a part of the volume of pressure chamber 34.

The setting of a volume V of pressure chamber 34 and the setting of an opening area D2 of communication port 36 between the discharge passage 35 and the pressure chamber 34 are hereinafter described in detail.

Figure 3:
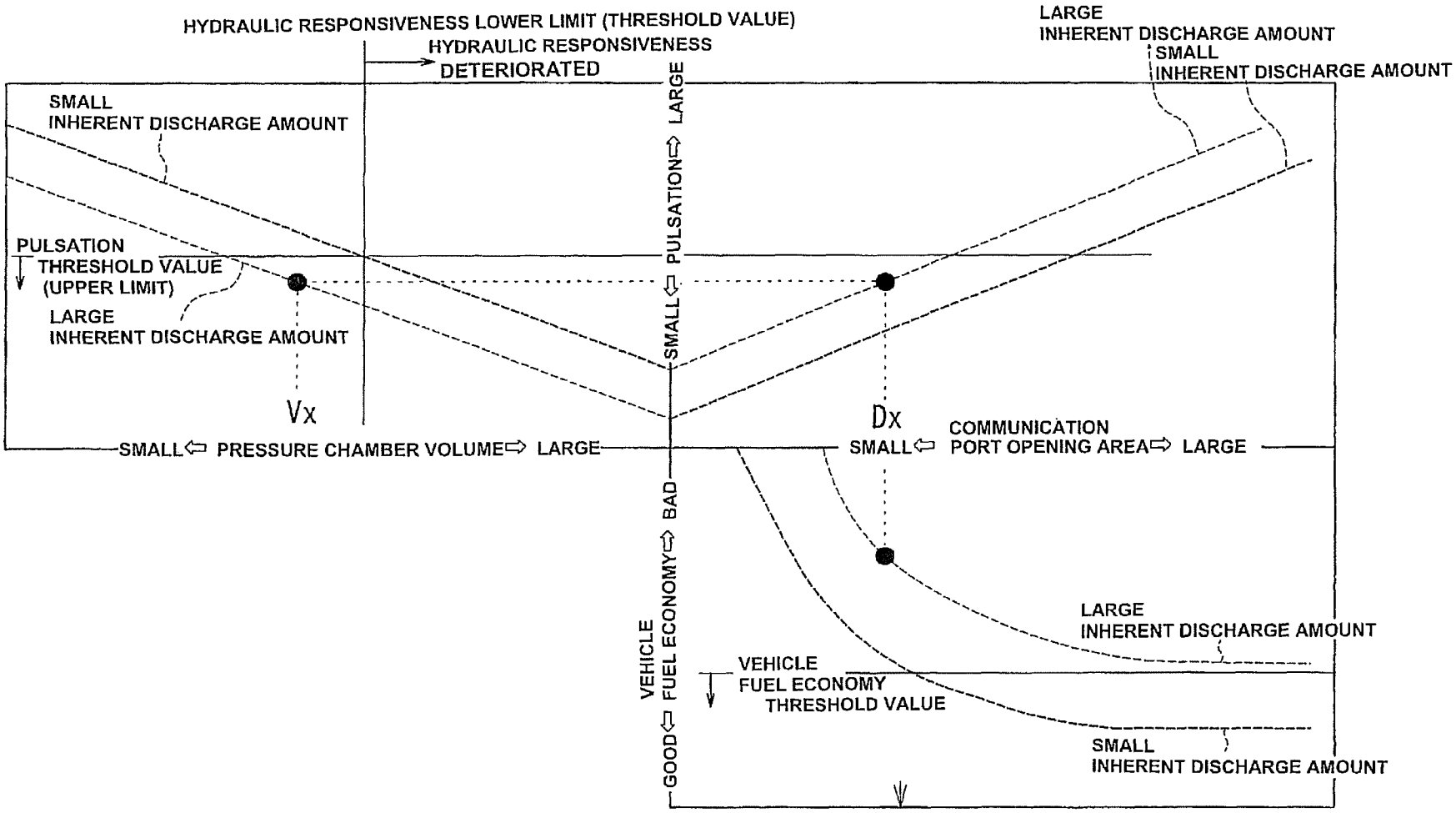
FIG. 3 is an explanatory drawing illustrating the relationship among the volume of a pressure chamber, the opening area of a communication port through which the discharge passage communicates with the pressure chamber, and the vehicle fuel economy.

Referring now to FIG. 3, there is shown the explanatory view collectively illustrating (1) the relationship between the magnitude of volume V of pressure chamber 34 (a pressure-chamber volume) and the magnitude of a pulsation, (2) the relationship between the magnitude of opening area D2 of communication port 36 (a communicating-part opening area) and the magnitude of a pulsation, and (3) the relationship between the magnitude of opening area D2 of communication port 36 (a communicating-part opening area) and the improvement/deterioration of vehicle fuel economy.

In FIG. 3, as appreciated from the relationships (1), (2), the magnitude of volume V of pressure chamber 34 and the magnitude of opening area D2 of communication port 36 are correlated to each other by the magnitude of a pulsation common to them. Furthermore, as appreciated form the relationships (2), (3), the magnitude of a pulsation and the improvement/deterioration of vehicle fuel economy are correlated to each other by the magnitude of opening area D2 of communication port 36 (a communicating-part opening area) common to them.

Also, the aforementioned relationships (1) to (3) vary depending on a low discharge flow rate of oil pump 1 (a low inherent discharge flow rate) or a high discharge flow rate of oil pump 1 (a high inherent discharge flow rate). In the case of the relationship (1), the magnitude of a pulsation tends to widely vary, even for a same volume of pressure chamber 34, depending on the discharge flow rate of oil pump 1. In the case of the relationship (2), the magnitude of a pulsation tends to widely vary, even for a same opening area D2 of communication port 36, depending on the discharge flow rate of oil pump 1. Furthermore, in the case of the relationship (3), the vehicle fuel economy tends to widely vary, even for a same opening area D2 of communication port 36, depending on the discharge flow rate of oil pump 1.

<Relationship Between Volume V of Pressure Chamber 34 and Pulsation>

As shown in FIG. 3, regarding the relationship between the volume V of pressure chamber 34 and the pulsation, the pulsation tends to decrease regardless of the discharge flow rate of oil pump 1, as the volume V of pressure chamber 34 increases. In other words, the pulsation tends to increase regardless of the discharge flow rate of oil pump 1, as the volume V of pressure chamber 34 decreases.

This is because oil discharged from the discharge opening 241 cannot be held in the pressure chamber 34 until such time the pulsation of the discharged oil subsides, as the volume V of pressure chamber 34 decreases.

<Relationship Between Opening Area D2 of Communication Port 36 and Pulsation>

Also, regarding the relationship between the magnitude of opening area D2 of communication port 36 between the pressure chamber 34 and the discharge passage 35 and the pulsation, the pulsation tends to decrease regardless of the discharge flow rate of oil pump 1, as the opening area D2 of communication port 36 decreases. In other words, the pulsation tends to increase regardless of the discharge flow rate of oil pump 1, as the opening area D2 of communication port 36 increases.

This is because, as the opening area D2 decreases, a flow resistance to the flow of oil passing or flowing through the communication port 36 tends to increase, and thus the increased resistance contributes to a reduction of pulsation. Conversely, as the opening area D2 increases, a flow resistance to the flow of oil flowing through the communication port tends to decrease, and as a result the pulsation reducing effect is deteriorated. Owing to the deteriorated pulsation reduction effect, the pulsation whose magnitude has not been reduced sufficiently may be transmitted to the oil in discharge passage 35.

<Relationship Between Opening Area D2 of Communication Port 36 and Vehicle Fuel Economy>

Regarding the relationship between the magnitude of opening area D2 of communication port 36 and the vehicle fuel economy, the vehicle fuel economy tends to deteriorate, regardless of the discharge flow rate of oil pump 1, as the opening area D2 of communication port 36 decreases. In other words, the vehicle fuel economy tends to improve, regardless of the discharge flow rate of oil pump 1, as the opening area D2 of communication port 36 increases.

This is because, as the opening area D2 decreases, a flow resistance to the flow of oil passing or flowing through the communication port 36 tends to increase, and thus a discharging power (in other words, a discharging load) required for oil to pass or flow through the communication port 36 also tends to increase. In order to increase the discharging power, the inner rotor 22 of oil pump 1 has to be rotated at a higher revolution speed. The load required for operating the oil pump 1 (i.e., the load required for rotating the inner rotor) at high revolution speeds becomes greater.

By the way, inner rotor 22 is rotated by a rotational driving force transmitted from a driving power source such as an engine, and thus the load (torque) required for rotating the inner rotor 22 just serves as the load on the driving power source. Thus, as the load on the inner rotor increases, the load on the driving power source also increases, and as a result the fuel economy of a driving-power-source equipped vehicle (i.e., the vehicle fuel economy) tends to be deteriorated. For the reasons discussed above, as the opening area D2 of communication port 36 decreases, the vehicle fuel economy deteriorates. Conversely, as the opening area D2 of communication port 36 increases, the vehicle fuel economy improves.

Hereupon, in setting both of the volume V of pressure chamber 34 (a pressure-chamber volume) and the opening area D2 of communication port 36 (a communication-port opening area), a fuel-economy characteristic of an automatic transmission equipped vehicle that has adopted the oil pump 1, a pulsation characteristic of the oil pump 1, and a hydraulic responsiveness of the oil pump 1 are taken into account by the applicant of the present application.

Concretely, the fuel-economy characteristic is correlated to the load on the oil pump 1 determined based on the opening area D2 of communication port 36. The pulsation characteristic is correlated to both the opening area D2 of communication port 36 and the volume V of pressure chamber 34. The hydraulic responsiveness is correlated to the volume V of pressure chamber 34. Therefore, threshold values of these characteristics and responsiveness are, first, determined, and then the volume V of pressure chamber 34 (a pressure-chamber volume) and the opening area D2 of communication port 36 (a communication-port opening area) are set in a manner so as to satisfy conditions that are determined based on these threshold values.

The setting of volume V of pressure chamber 34 (a pressure-chamber volume) and the setting of opening area D2 of communication port 36 (a communicating-part opening area) are hereunder explained.

Figure 4:
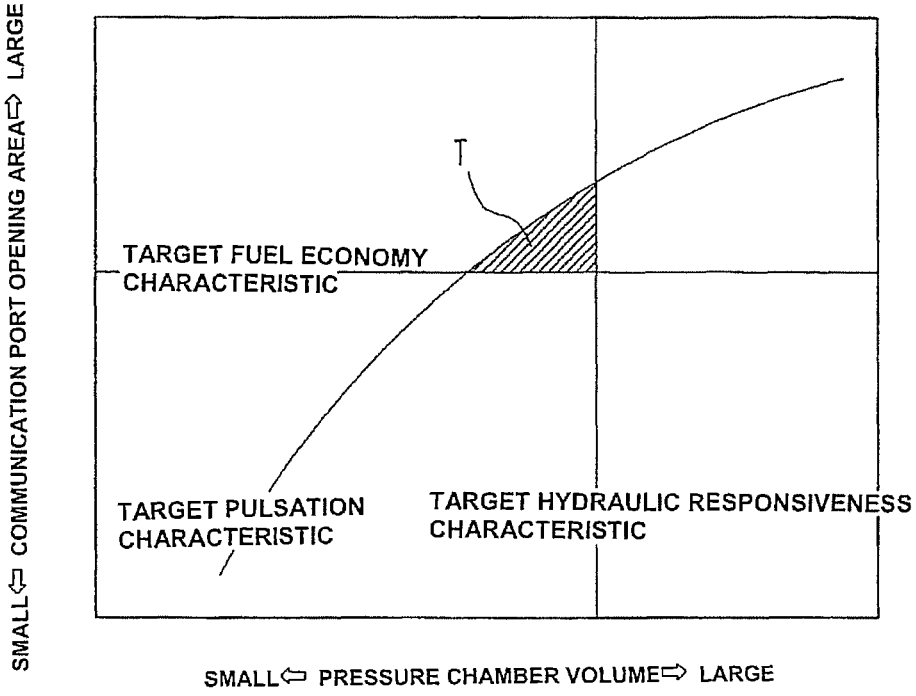
FIG. 4 is an explanatory drawing illustrating the volume setting of the pressure chamber and the opening-area setting of the communication port.

Referring now to FIG. 4, there is shown the explanatory drawing illustrating the setting of volume V of pressure chamber 34 (a pressure-chamber volume) and the setting of opening area D2 of communication port 36 (a communication-port opening area). This explanatory drawing is a characteristic diagram illustrating characteristic lines/curve (i.e., a target fuel-economy characteristic line, a target pulsation characteristic curve, and a target hydraulic responsiveness characteristic line) whose characteristics should be taken into account in setting both the volume V of pressure chamber 34 and the opening area D2 of communication port 36.

<Fuel-Economy Characteristic>

In the shown embodiment, regarding the fuel economy characteristic, a threshold value of vehicle fuel economy (i.e., a minimum value of fuel consumption to be achieved) is determined based on a contributory portion of the oil pump that contributes to a target fuel consumption required for a vehicle equipped with the oil pump 1.

Concretely, first of all, a threshold value such that an increasing amount of load torque of oil pump 1 becomes less than or equal to a given value (for example, 0.1 Nm) when the revolution speed of oil pump 1 changes from an idling speed to a given revolution speed (for example, with a revolution speed change from 600 rpm to 2000 rpm) is found or set as a threshold value of vehicle fuel economy (see the vehicle fuel economy threshold value shown in FIG. 3). Next, the target fuel economy characteristic (see FIG. 4) is determined based on the found threshold value of vehicle fuel economy.

Hereupon, the vehicle fuel economy changes mainly depending on the opening area D2 of communication port 36 (i.e., the load of oil pump 1), but depends very little on the volume V of pressure chamber 34. Accordingly, the relationship of the target fuel economy characteristic with the volume V of pressure chamber 34 and the opening area D2 of communication port 36 has a linearity as shown in FIG. 4.

By the way, as can be appreciated from FIG. 4, as the opening area D2 of communication port 36 narrows, the load of oil pump 1 increases and thus the fuel economy deteriorates. In setting both the volume V of pressure chamber 34 and the opening area D2 of communication port 36 based on the characteristic diagram of FIG. 4, it is preferable to set the communication port opening area as well as the pressure chamber volume on a specified side that the opening area D2 of communication port 36 becomes larger, as viewed from the target fuel economy characteristic line.

Hereupon, the target fuel economy characteristic is an upper limit of a burden share of the oil pump 1 that affects a load torque of a vehicle equipped with the oil pump 1.

<Hydraulic Responsiveness Characteristic>

Also, the hydraulic responsiveness changes depending on the volume V of a region (in the case of the embodiment shown in FIG. 1, pressure chamber 34, discharge passage 35, and oil passage 100) that can function as the pressure chamber 34. The hydraulic responsiveness deteriorates, as the volume V increases.

In the shown embodiment, a volume that satisfies a specified condition defined by the following expression (1) is found or set as a threshold value of the hydraulic responsiveness (see the hydraulic responsiveness threshold value in FIG. 3). Next, the target hydraulic responsiveness characteristic is determined based on the found threshold value of the hydraulic responsiveness.

a discharge amount $Q$ of oil pump 1 per unit time× target hydraulic pressure rise time $T$=a discharge amount (l/min) of oil pump 1 at low temperature≥a pressure chamber volume $V$ (1)

Hereupon, in the case of the oil pump 1 of the embodiment, volumes of pressure chamber 34, discharge passage 35, and oil passage 100 are all involved in the aforementioned pressure chamber volume.

As discussed above, in the shown embodiment, the volume of discharge passage 35 is involved in the pressure chamber volume of the above expression (1), and hence the hydraulic responsiveness does not depend on the opening area D2 of communication port 36. Accordingly, the relationship of the target hydraulic responsiveness characteristic with the pressure chamber volume V and the opening area D2 of communication port 36 has a linearity as shown in FIG. 4.

By the way, as can be appreciated from FIG. 4, as the pressure chamber volume increases, the hydraulic responsiveness deteriorates. In setting both the volume V of pressure chamber 34 and the opening area D2 of communication port 36 based on the characteristic diagram of FIG. 4, it is preferable to set the communication port opening area as well as the pressure chamber volume on a specified side that the pressure chamber volume becomes smaller, as viewed from the target hydraulic responsiveness characteristic line.

<Pulsation Characteristic>

The pulsation characteristic changes depending on the volume V of a region (in the case of the embodiment shown in FIG. 1, pressure chamber 34, discharge passage 35, and oil passage 100) that can function as the pressure chamber 34, and also depends on the opening area D2 of communication port 36.

In the shown embodiment, a pulsation threshold value is set, focusing on a noise caused by pulsation during vehicle running. The magnitude of pulsation that the noise level becomes less than or equal to a prescribed noise level (unit: decibel) in a steady-state running state is found or set as a pulsation threshold value (see the pulsation threshold value shown in FIG. 3). Next, the target pulsation characteristic is determined based on the found threshold value of pulsation.

Concretely, of the relationship of the target pulsation characteristic with the opening area D2 of communication port 36 and the relationship of the target pulsation characteristic with the pressure chamber volume V, the relationship corresponding to the found pulsation threshold value is determined as a prescribed reference (a prescribed reference value). Thereafter, a target pulsation characteristic curve is prescribed based on the prescribed reference value and the function value of a function defined by $(M-(1/M))^2\times La$, where M denotes an expansion coefficient S2/S1, S1 denotes a cross-sectional area of the inlet side of communication port 36 (that is, a cross-sectional area of pressure chamber 34), S2 denotes a cross-sectional area of the outlet side of communication port 36 (that is, a cross-sectional area of discharge passage 35), and La denotes a crossing length between the one end 35*b* of discharge passage 35 and the pressure chamber 34 in the rotation axis X direction.

By the way, the pulsation characteristic depends on both the opening area D2 of communication port 36 and the pressure chamber volume V, and thus the relationship of the target pulsation characteristic with the pressure chamber volume V and the opening area D2 of communication port 36 has a curvilinearity (a characteristic curve) as shown in FIG. 4.

Hereupon, the pressure chamber volume is superior to the opening area D2 of communication port 36 in a contribution rate that reduces pulsation. In setting both the volume V of pressure chamber 34 and the opening area D2 of communication port 36 based on the characteristic diagram of FIG. 4, it is preferable to set the communication port opening area as well as the pressure chamber volume on a specified side that the pressure chamber volume becomes larger as viewed from the target pulsation characteristic curve.

Accordingly, in the shown embodiment, the pressure chamber volume (volumes of pressure chamber 34, discharge passage 35, and oil passage 100) and the opening area D2 of communication port 36 are set in a manner so as to be included in a specified region T (see the right-hand diagonal shading region indicated by hatching in FIG. 4) surrounded by the previously-discussed three characteristic lines/curve. As a result of this, the oil pump 1 is configured to satisfy or balance all of the fuel economy characteristic, the pulsation characteristic, and the hydraulic responsiveness.

Hereupon, the target pulsation characteristic is set to an upper limit of pulsation (oil flow oscillations) of oil pump 1, which upper limit is calculated based on a prescribed noise level of noise to be suppressed in a vehicle equipped with the oil pump 1. The target pulsation characteristic is represented by an equivalent curve that utilizes the volume V of a space (in the case of the embodiment shown in FIG. 1, pressure chamber 34, discharge passage 35, and oil passage 100) that can function as the pressure chamber and the opening area D2 of communication port 36 as parameters.

(1) As discussed above, an oil pump 1 of the embodiment is provided with an inner rotor 22 configured to rotate integrally with a shaft 20 (a drive shaft) around a rotation axis X, an outer rotor 23 disposed in a loose-fit state within a pump chamber 31 formed in a housing 3 and having an internal toothed portion provided on an inner periphery of the outer rotor and meshed with an external toothed portion provided on an outer periphery of the inner rotor 22, a pressure chamber 34 (a space) provided adjacent to the pump chamber 31 in a direction of the rotation axis X and formed into a ring shape surrounding the rotation axis X, when viewed in the rotation axis X direction, a discharge opening 241 for connecting the pump chamber 31 and the pressure chamber 34, and a discharge passage 35 formed to extend parallel to the rotation axis X in the housing 3 and having one end 35*b* connected to the pressure chamber 34 in a longitudinal direction and the other end serving as a discharge port (connection opening 35*a*) that opens at a position spaced away from the pump chamber 31 and the pressure chamber 34 in the rotation axis X direction. The discharge passage 35 is formed to have a circular cross-sectional shape when viewed in the rotation axis X direction, and is provided at a position bridging an inside and outside of an outer periphery of the pressure chamber 34 when viewed in the rotation axis X direction. The one end 35*b* of the discharge passage 35 is provided at a position reaching to a middle 34*c* of the pressure chamber 34 when viewed in a radial direction of the rotation axis X, such that the discharge passage 35 and the pressure chamber 34 are configured to be in direct communication with each other.

With the previously-discussed configuration, the pressure chamber 34, into which the pressurized oil within the pump chamber 31 first flows, and the discharge passage 35, through which the pressurized oil supplied into the pressure chamber 34 is introduced into the connection opening 35*a*, are in direct communication with each other. Hence, there is not any flow-constricting part (any flow constriction) serving as a flow resistance to the flow of oil flowing from the pressure chamber 34 into the discharge passage 35 and provided between the pressure chamber 34 and the discharge passage 35.

Therefore, a portion of the discharge passage 35 is also utilized as a part of the pressure chamber 34, and thus the volume of the pressure chamber 34 can be regarded as to be increased by a volumetric capacity corresponding to the discharge passage 35. By virtue of the increased volume of the pressure chamber 34, the effect that suppresses the pulsation of the pressurized oil flowing from the pump chamber 31 into the pressure chamber can be enhanced accordingly.

With the configuration as discussed above, it is possible to enlarge the volume of the fluid-flow space that can function as the pressure chamber 34 without increasing the actual volume of the pressure chamber 34 itself. Therefore, it is possible to more effectively suppress the pulsation of the pressurized oil.

(2) An opening area D2 of a communication port 36 between the discharge passage 35 and the pressure chamber 34 is set greater than or equal to an opening area D1 of the connection opening 35*a* of the discharge passage 35.

With the aforementioned configuration, any flow constriction (any flow constricting orifice) serving as a flow resistance to the flow of oil is not caused or formed in the middle of the movement (the flow) of oil in the pressure chamber 34 toward the discharge passage 35. Therefore, a portion of the discharge passage 35 can be utilized as a part of the space. Hence, it is possible to enlarge the volume of the fluid-flow space that can function as the pressure chamber 34 without increasing the actual volume of the pressure chamber 34 itself. Therefore, it is possible to more effectively suppress the pulsation of the pressurized oil.

(3) A volume of the pressure chamber 34 and an opening area D2 of the communication port 36 are set, in a table (see FIG. 4) that utilizes the volume of the pressure chamber 34 and the opening area D2 of the communication port 36 as parameters, to a given volume and a given opening area included in a specified region surrounded by a target pulsation characteristic curve representing a target pulsation characteristic for prescribing a permissible pulsation upper limit of a pulsation that varies depending on the volume of the pressure chamber (i.e., pressure chamber 34, discharge passage 35, and oil passage 100) and the opening area D2 of the communication port 36, a target fuel economy characteristic line representing a target fuel economy characteristic for prescribing a permissible fuel consumption lower limit of a fuel consumption that varies depending on the opening area D2 of the communication port 36, and a target hydraulic responsiveness characteristic line representing a target hydraulic responsiveness characteristic for prescribing a permissible hydraulic responsiveness lower limit of a hydraulic responsiveness of the oil pump that varies depending on the volume of the pressure chamber (i.e., pressure chamber 34, discharge passage 35, and oil passage 100).

With the aforementioned configuration, it is possible to provide the oil pump 1 in which any of the hydraulic responsiveness characteristic, the pulsation characteristic (containing a quietness), and the fuel economy characteristic satisfies a required characteristic.

Hence, it is possible to provide the oil pump 1 capable of providing an improved hydraulic responsiveness, ensuring suppresses pulsation, and effectively preventing the fuel economy of a vehicle equipped with the oil pump from deteriorating, without greatly changing the volume and/or layout of each of the pressure chamber 34 and the discharge passage 35, both formed in the body case 2, thereby effectively preventing the layout/installation flexibility around the oil pump from deteriorating.

Additionally, for every vehicle, the volume of pressure chamber 34 and the opening area In of communication port 36 can be set to an appropriate volume and an appropriate opening area, respectively.

(4) The target pulsation characteristic is set to an upper limit of oil flow oscillations of the oil pump, the upper limit being calculated based on a prescribed noise level of noise to be suppressed in a vehicle equipped with the oil pump 1. The target pulsation characteristic is represented by an equivalent curve that utilizes the volume V of the space (in the case of the embodiment shown in FIG. 1, pressure chamber 34, discharge passage 35, and oil passage 100) that can function as the pressure chamber and the opening area D2 of the communication port 36 as parameters.

With the aforementioned configuration, the target pulsation characteristic can be determined based on the past experimental data. Hence, an ambiguity such as a sensory test is not involved in determining whether or not a pulsation is within a permissible level, and thus the level of pulsation can be determined with a constant stability.

(5) The target fuel economy characteristic is an upper limit of a burden share of the oil pump that affects a load torque of a vehicle equipped with the oil pump 1.

With the aforementioned configuration, the target fuel economy characteristic can be determined based on the past experimental data. Hence, it is possible to suppress a deterioration of vehicle fuel economy which may occur owing to a discharging load (an exhausting load) in the oil pump.

Additionally, the volume V of a space (in the case of the embodiment shown in FIG. 1, pressure chamber 34, discharge passage 35, and oil passage 100) that can function as the pressure chamber, and the opening are D2 of communication port 36 can be set such that a deterioration of vehicle fuel economy can be suppressed. Hence, the volume of the space and the opening area D2 of communication port 36 can be appropriately set depending on each individual vehicle, while effectively suppressing a deterioration of vehicle fuel economy.

In the shown embodiment, in FIG. 1, pressure chamber 34, discharge passage 35, and oil passage 100 are exemplified as a space that can function as a pressure chamber. In lieu thereof, another space (i.e., pressure chamber 34 and discharge passage 35) excluding the oil passage 100 may be set as a space that can function as a pressure chamber.

The invention claimed is:

1. An oil pump comprising:

an inner rotor configured to rotate integrally with a drive shaft around a rotation axis;

an outer rotor disposed within a pump chamber formed in a housing and having an internal toothed portion provided on an inner periphery of the outer rotor and meshed with an external toothed portion provided on an outer periphery of the inner rotor;

a space provided adjacent to the pump chamber in a direction of the rotation axis and formed into a ring shape surrounding the rotation axis, when viewed in the direction of the rotation axis;

a connection passage for connecting the pump chamber and the space; and a cylindrical discharge passage formed to extend parallel to the rotation axis in the housing and having one end connected to the space in the direction of the rotation axis and another end serving as a discharge port that opens at a position within the oil pump and being spaced apart from both the pump chamber and the space in the direction of the rotation axis, wherein the discharge passage is provided in the housing such that a portion of the discharge passage is located to open inside of an outer periphery of the space when viewed in the direction of the rotation axis, and wherein the one end of the discharge passage is provided at a position extending to a middle of the space when viewed in a radial direction of the rotation axis, such that the discharge passage and the space are in direct communication with each other.

2. The oil pump as recited in claim 1, wherein:

an opening area of a communication port between the discharge passage and the space is set greater than or equal to an opening area of the discharge port of the discharge passage.

3. The oil pump as recited in claim 2, wherein:

a volume of the space and an opening area of the communication port are respectively set, in a table that utilizes the volume of the space and the opening area of the communication port as parameters, to a given volume and a given opening area included in a specified region between a target pulsation characteristic curve representing a target pulsation characteristic for prescribing a permissible pulsation upper limit of a pulsation that varies depending on the volume of the space and the opening area of the communication port, a target fuel economy characteristic line representing a target fuel economy characteristic for prescribing a permissible fuel consumption lower limit of fuel consumption that varies depending on the opening area of the communication port, and a target hydraulic responsiveness characteristic line representing a target hydraulic responsiveness characteristic for prescribing a permissible hydraulic responsiveness lower limit of a hydraulic responsiveness of the oil pump that varies depending on the volume of the space.

4. The oil pump as recited in claim 3, wherein:

the target pulsation characteristic is set to an upper limit of oil flow oscillations of the oil pump, the upper limit being calculated based on a prescribed noise level of noise to be suppressed in a vehicle equipped with the oil pump, and the target pulsation characteristic is represented by an equivalent curve that utilizes the volume of the space and the opening area of the communication port as parameters.

5. The oil pump as recited in claim 3, wherein:

the target fuel economy characteristic is an upper limit of a burden share of the oil pump that affects a load torque of a vehicle equipped with the oil pump.

* * * * *